US006176193B1

(12) United States Patent
Whitby et al.

(10) Patent No.: US 6,176,193 B1
(45) Date of Patent: Jan. 23, 2001

(54) VESSEL TURRET SYSTEMS

(75) Inventors: Ian Whitby, Thamesmead; Mehmet Ismet Basaran, Middlesex; Philip Raymond Hawley, East Sussex, all of (GB)

(73) Assignee: J. Ray McDermott S.A., New Orleans, LA (US)

( * ) Notice: Under 35 U.S.C. 154(b), the term of this patent shall be extended for 0 days.

(21) Appl. No.: 09/242,351

(22) PCT Filed: Aug. 15, 1997

(86) PCT No.: PCT/GB97/02204

§ 371 Date: Feb. 15, 1999

§ 102(e) Date: Feb. 15, 1999

(87) PCT Pub. No.: WO98/07616

PCT Pub. Date: Feb. 26, 1998

(30) Foreign Application Priority Data

Aug. 16, 1996 (GB) ..... 9617209

(51) Int. Cl.[7] ..... B63B 21/00
(52) U.S. Cl. ..... 114/230.12
(58) Field of Search ..... 114/230.12, 230.1; 441/3–5

(56) References Cited

U.S. PATENT DOCUMENTS 3,335,690 8/1967 Busking .
3,407,768 10/1968 Graham .
4,254,523 3/1981 Kentosh .
4,301,840 11/1981 Jansen .
5,381,750 1/1995 Pollack .

FOREIGN PATENT DOCUMENTS 0 259 072 * 3/1988 (EP) .
2 150 517 * 7/1985 (GB) .
WO93/11032 * 6/1993 (WO) .

* cited by examiner

*Primary Examiner*—Sherman Basinger
(74) *Attorney, Agent, or Firm*—R. J. Edwards; E. Marich; R. C. Baraona

(57) ABSTRACT

A turret system is installed on an existing vessel such as an oil tanker. A portion of the existing structure, such as the center splice, is removed to leave an opening. A support structure is attached within the opening. The support structure includes a turret support structure. The turret structure is assembled within the turret support structure. Fluid piping is installed between the turret structure and the pipework of the vessel, including a manifold structure and a fluid swivel. The turret assembly is cladded for environmental protection. In one arrangement, the turret system is within the profile of the original vessel. In another arrangement, the turret system is external to the profile of the original vessel.

34 Claims, 6 Drawing Sheets

VESSEL TURRET SYSTEMS

FIELD AND BACKGROUND OF THE INVENTION

This invention relates to vessel turret systems, that is systems that can be used in offshore terminals comprising dedicated vessels, for providing fluid couplings between the vessel and subsea risers/pipelines.

It has been previously proposed to convert a vessel such as an oil tanker into a floating production storage and offloading (FPSO) system by attaching a turret assembly to one end, generally the bow, of the vessel. The turret assembly includes a fluid swivel allowing relative rotation between, firstly, the seabed and associated production risers, mooring chains etc. and, secondly, the vessel itself while maintaining a continuous flow path for production fluids from the subsea well into the vessel. The previously-proposed mounting of the turret assembly has been significantly outboard of the end of the vessel, which has resulted in the turret assembly being exposed to adverse environmental effects, as well as requiring a complex structural mounting arrangement attached to suitable load-bearing portions of the vessel end. Accordingly, once the turret assembly had been fitted, the conversion was effectively permanent, or at least semi-permanent in that considerable work would be required to remove the turret assembly.

SUMMARY OF THE INVENTION

It is an aim of the invention to provide such a vessel turret system which is modular in design and which can accordingly be readily fitted to the deck of a tanker (or other suitable vessel), and also can be removed with minimum effort and cost, so that the vessel can then be used again for its original purpose.

According to a first aspect of the invention there is provided a method of installing a turret system on to an existing vessel, the method comprising the steps of:

removing a portion of the existing structure of the vessel at one end thereof, the removed portion including external plating;

attaching a support structure to an exposed portion of the vessel remaining after removal of the existing structure portion, the support structure including turret support means and metal plating attached to the exposed portion;

attaching a turret assembly to the turret support means of the support structure;

installing fluid piping between the turret assembly and pipework of the vessel; and cladding the turret assembly for environmental protection thereof.

According to a second aspect of the invention there is provided a floating production storage and offloading (FPSO) vessel, including a turret system installed on a converted vessel, the FPSO vessel comprising:

a support structure attached to an exposed portion of the vessel remaining after removal of a portion of the existing structure including external plating, the support structure including turret support means and metal plating attached to the exposed portion;

a turret assembly attached to the turret support means;

fluid piping between the turret assembly and pipework of the vessel; and cladding around the turret assembly for environmental protection thereof.

In a preferred embodiment, a framework structure may be attached at the top of the turret assembly, to the weather deck of the vessel. In one arrangement, the turret system is mounted externally of the original end (bow) of the vessel wherein the support structure includes extension structures such as plates attached to the existing decks of the vessel, forming deck extensions. Vertical extension plates may also be provided at each side of the deck extensions, and horizontal stringers may also be attached to the vessel at different levels to the deck extensions. The extension plates and stringers include respective apertures for accepting and retaining the turret assembly. In another arrangement, the turret system is mounted at least partially, preferably at least substantially, within the profile of the original vessel. In this arrangement, the centre splice of the vessel is removed and longitudinal support structure plating is attached in its place. A turret casing is assembled to the support structure plating. Once the turret assembly has been fitted in the turret casing, a manifold structure is attached at the top of the turret casing, and then a fluid swivel is installed over the manifold structure.

Conversion of a vessel such as an oil tanker can be effected readily using these techniques. The resulting vessel turret systems are strong and well-protected against environmental effects. Moreover, the modular nature of conversion designs means that, as well as simplifying the installation process, the turret systems can be readily removed, allowing the vessel to be used once more for its original purpose.

BRIEF DESCRIPTION OF THE DRAWINGS

The invention will now be described by way of example with reference to the accompanying drawings, throughout which like parts are referred to by like references, and in which.

DESCRIPTION OF THE PREFERRED EMBODIMENTS

Figure 1A:
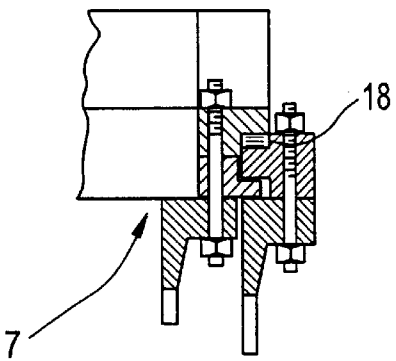
FIG. 1 is a schematic side sectional view of an external mounted bow turret according to one embodiment of the invention.
Figure 1:
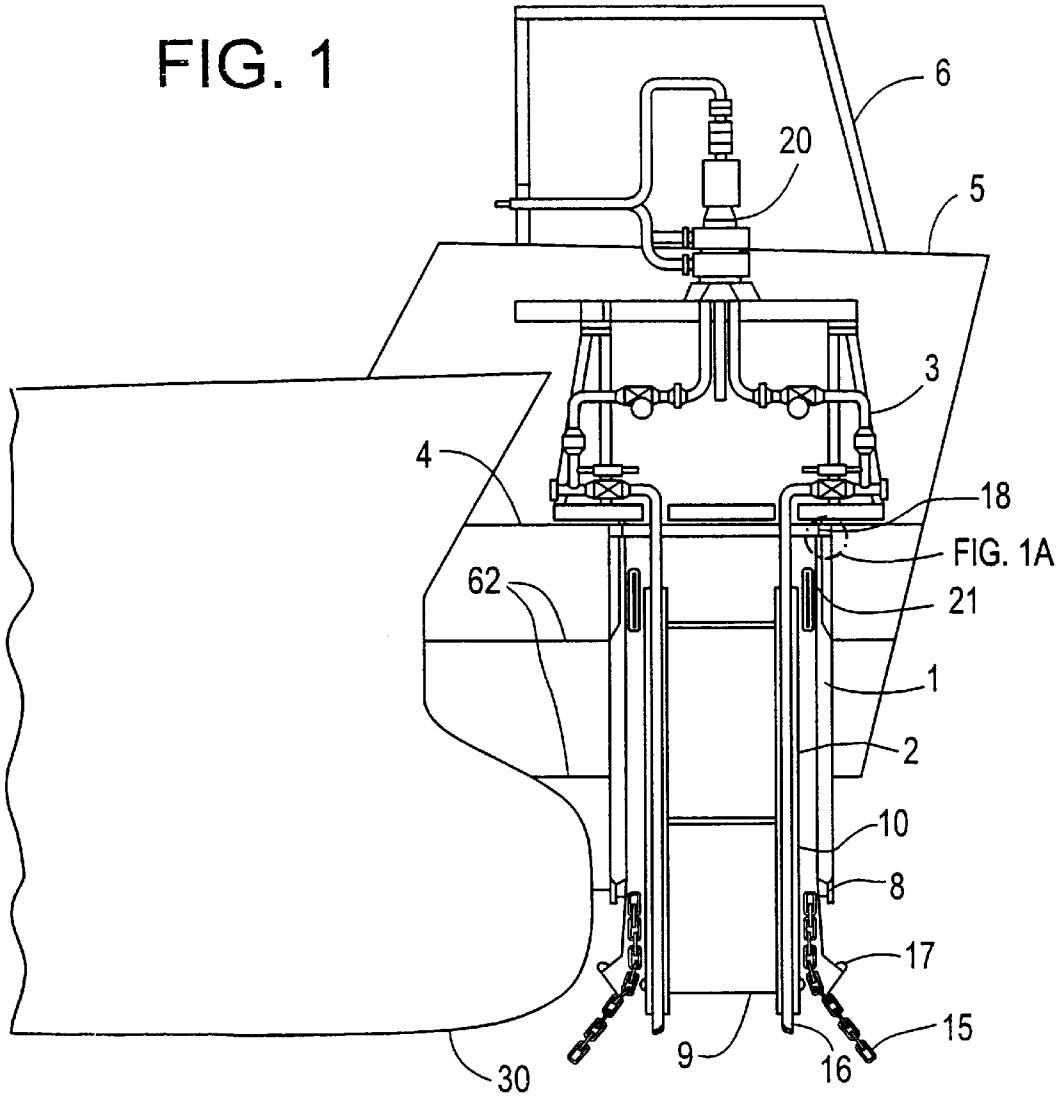
Figure 2A:
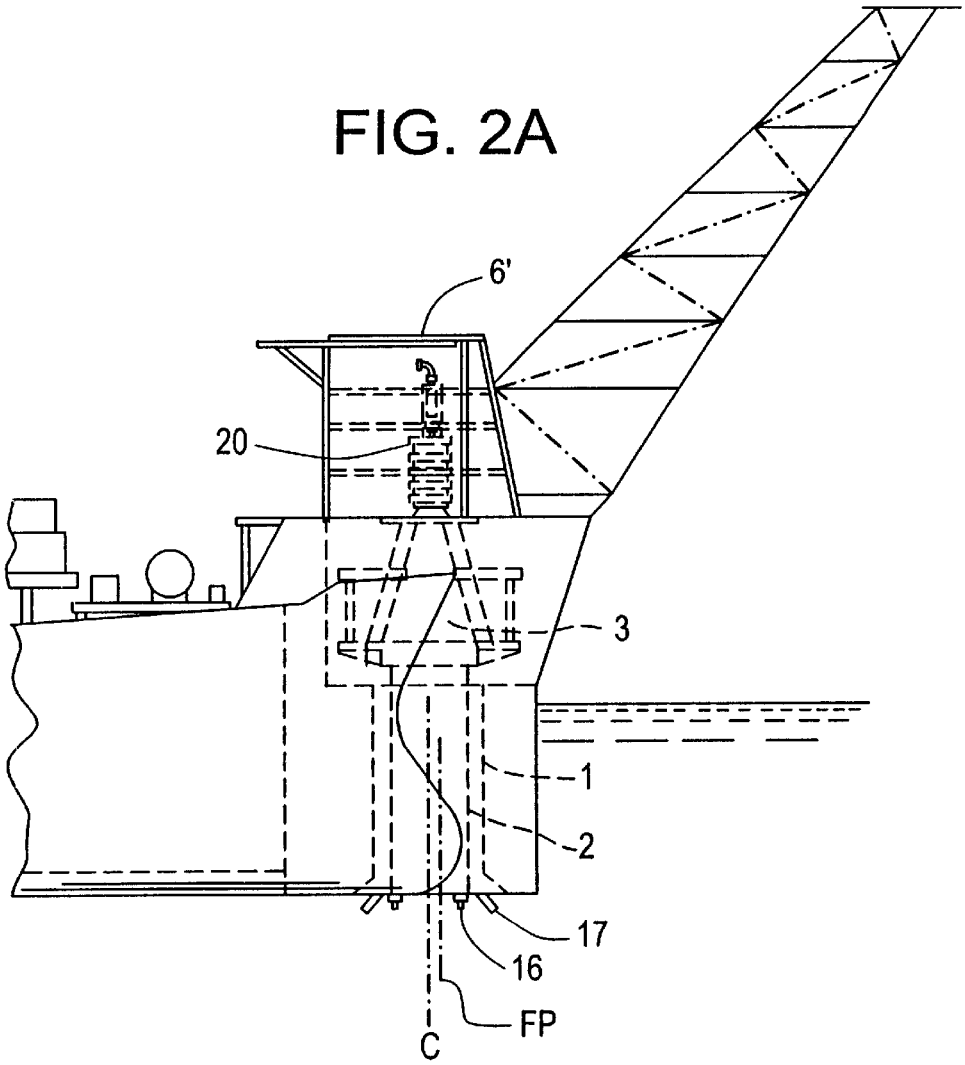
FIGS. 2A and 2B are respectively schematic side sectional and plan views of an integrated bow mounted turret according to another embodiment of the invention.
Figure 2B:
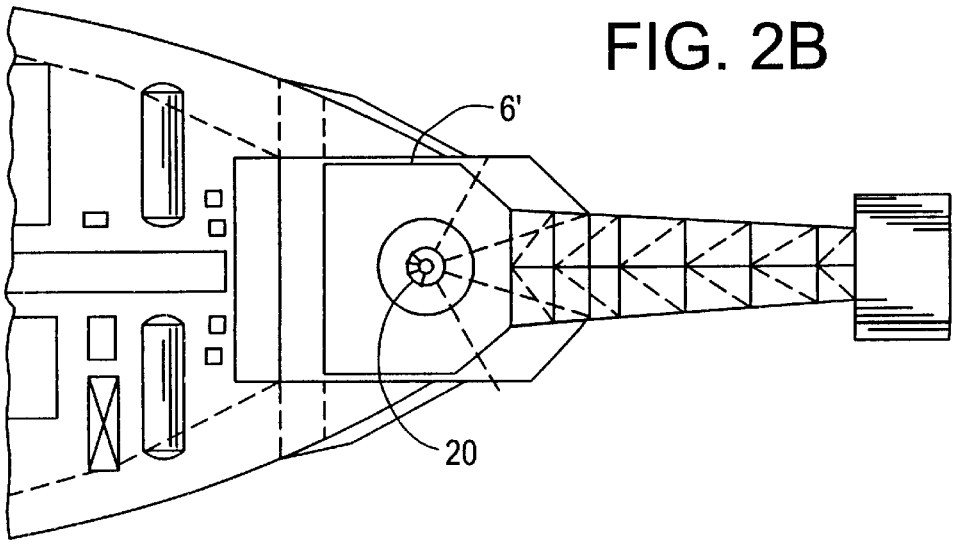

Referring to FIG. 1, there is shown an external bow-mounted turret which consists of two cylinders with concentric vertical axes, an outer cylinder 1 and an inner cylinder 2. The inner cylinder 2, which remains geostationary and is watertight, supports mooring chains 15 and risers 16. Each chain 15 is held by a respective chain stopper 21 which is positioned just below the top of the inner turret cylinder 2. In order to accommodate varying chain angles, each chain 15 passes through a specially designed fairlead 17, which protrudes below the bottom of the turret. The centre of the turret is designed to be fully accessible by ladder (not shown) for maintenance and inspection. The integrated bow-mounted turret of FIGS. 2A and 2B is broadly similar in respect of the configuration of the turret assembly.

In the arrangement of FIG. 1, the turret centreline is arranged forward of the tanker's Forward Perpendicular (FP) and is attached to the existing vessel's structure, as will be described. In the arrangement of FIGS. 2A and 2B, the turret centreline is marginally aft of the tanker's FP. In both cases, the turret manifold 3 is accessed at the level of the bearing deck 4 which is an extension of the vessel's second deck. The fore-end extension is open from the bearing deck level to the level of the weather deck 5. The weather deck 5 supports a framework structure 6 for environmental protection of the turret swivel assembly. This structure 6 is clad with plating, suitably reinforced to resist wave slam.

The upper structure of the inner tube or cylinder 2 is stiffened to resist the axial forces applied by the upper bearing 18.

An upper structure flange 7 supports the outer ring of the upper bearing 18, as can be seen in the enlarged detail of FIG. 1.

A support ring for the lower bearing 8 is designed to resist the forces applied by the chains 15 to the fairleads 17 and the bearing reactions.

A bottom end closure 9 of the turret is a stiffened plate designed to resist the maximum hydrostatic head imposed by the ship motions. It is also designed to support the forces imposed by riser shrouds 10. The riser shrouds 10 are connected to the upper decks to form an integrated structure.

The top deck is designed to be watertight against flooding of the lower space.

As can be seen in FIG. 1, the turret is cantilevered forward of the bow of the vessel. The turret forms a cylinder hub around which the vessel rotates by means of a bearing system. The bearing system is formed by a three roller upper bearing 18 which is positioned at the top of the turret, and the lower bearing 8 towards the bottom of the turret. The deflections of the turret due to mooring loads are an order of magnitude lower than the clearance between the inner cylinder 2 and the outer cylinder 1 so jamming will not occur.

The basic turret is preferably positioned between a spread of twelve catenary anchor lines or chains 15, and has an earth-bound orientation. The turret and vessel's relative position effects a passive weathervaning in extreme conditions so that vessel behaviour is not dependent on power supply or thruster operation.

The flexible flow lines or risers 1 6, which transfer the fluids from the seabed to the floating production storage and offloading (FPSO) turret, enter the turret structure through the bottom and continue to the top of the turret through the individual riser shrouds 10. Swivels 20, well known in this art, provide the fluid transfer link between the piping on the fixed turret and the weathervaning vessel.

The turret contains equipment to hook-up the anchoring chains 15, to fix them in stoppers and to hook-up the flexible risers 16.

The turret consists of two cylinders with vertical axes, the outer cylinder 1 and the inner cylinder 2, 6 m. old and 5.040 m. old respectively in one specific design. The outer cylinder 1 is 15.140 m. long and is stiffened internally with ring stiffeners. The inner cylinder 2, which remains geostationary and is watertight, supports the twelve mooring chains 15 and the six risers 16.

The turret centreline is located forward of the tanker's FP for the external bow-mounted turret of FIG. 1 and marginally behind the FP for the integrated turret of FIGS. 2A and 2B. In both cases, the turret is attached to the existing vessel's structure using typical ship's reinforced plating. All vertical and horizontal plating marries up with existing structure.

The upper structure flange 7, which supports the outer ring of the upper bearing 18, is preferably welded to the inner tube shell plating by full penetration weld.

The lower bearing 8 support ring, which is designed to resist the forces applied by the fairleads 17 and the bearing reactions, is preferably a forging. It may instead be possible to use a fabricated beam of I-section. The ring is welded into the shell plating using full penetration girth welds.

Chain boxes, which accommodate the chains 15, utilise the existing stiffeners on the shell plating. These are plated on the inside to form "boxes" which extend upwards from the fairleads 17 to the chain stoppers 18.

The chain stoppers 18 are formed from two cylindrical castings bolted to the chain. Each stopper 18 sits in a seat.

Provision is made for seals between the chain stoppers 18 preventing water leaking into the compartment during storms.

The riser shrouds 10 are of solid drawn steel pipe. In addition to their function of protecting the risers 16 and the compartments within the turret during blowout, their structural strength allows them to be integrated with the inner cylinder structure. This integration reduces the weight for the same strength. The bottom of each riser shroud 10 is flared to protect the riser 16 and assist in pull in.

The fairleads 17 are of the bend shoe type. This transfers the load from the chain 15 via the line of contact to the bend shoe support bracket. This shoe can be released by a diver and recovered to the surface for inspection.

The bend shoe of each fairlead 17 is provided with collars (not shown) to support slack chain; these avoid damage to the plate. The upper structure of the inner cylinder 2 is stiffened to resist the axial forces applied by the upper bearing 18.

At the turret/vessel interface of the external turret of FIG. 1, minimal stiffening needs to be added within the bow of the vessel. The modifications may involve the installation of columns, gussets and vertical plates; these will be chiefly located forward of the collision bulkhead.

The turret cylinders 1, 2 may be fabricated in several units, dictated by the fabricator's facility and equipment. The units in way of the bearings 8, 18 at either end of the turret will be stress relieved. After installation of the turret structure to the vessel, the top and bottom bearing support structure will be lined up and machined to a flat surface, to receive the bearings 8, 18. The inner and outer cylinders 2, 1 can then be assembled and mated. The choice of construction facility and availability of the vessel, will determine the procedure for fabrication. The vessel bow extension can either be installed on the vessel as subassemblies or in one piece.

The two bearings 8, 18 incorporated into the design of the turret are designed to take all the expected loads and to ensure an easy rotation of the vessel around the moorings and risers 16.

The upper bearing 18 is fitted at the top of the primary turret tubes. It is preferably a three-roller type, a variation of a standard commercially available design. The diameter may be approximately 5.81 meters.

The upper bearing 18 is bolted to ring forgings which, in turn, are welded to the turret structure. To ensure that there are no induced stresses in the structure, due to geometric variations, the bearing faces will be carefully machined after local structural welding and stress relieving, before final erection of the turret.

The lower bearing 8 is located at the bottom of the inner, fixed turret cylinder 2. The lower bearing 8 itself is preferably a composite material fitted in twelve segments to the cylinder 2 by bolts and slotted 'T' plates. The bearing faces will be designed to transfer all the loads to a hard-faced reaction forging, incorporated into the outer turret cylinder 1. These loads will be the radial components of all those loads described for the upper bearing 18.

The composite bearing material for the lower bearing 8 is preferably fabricated from hot laminated sheets and suitably cured. The resulting material can be machined, is extremely dense, and has a very good compressive strength, typically 414 $N/mm^2$. It also has the distinct advantage that it is self-lubricating in sea water. In these conditions the coefficient of friction is virtually zero.

The design of the lower bearing 8 may be such that each segment can be separately removed for survey and/or replacement.

Figure 3:
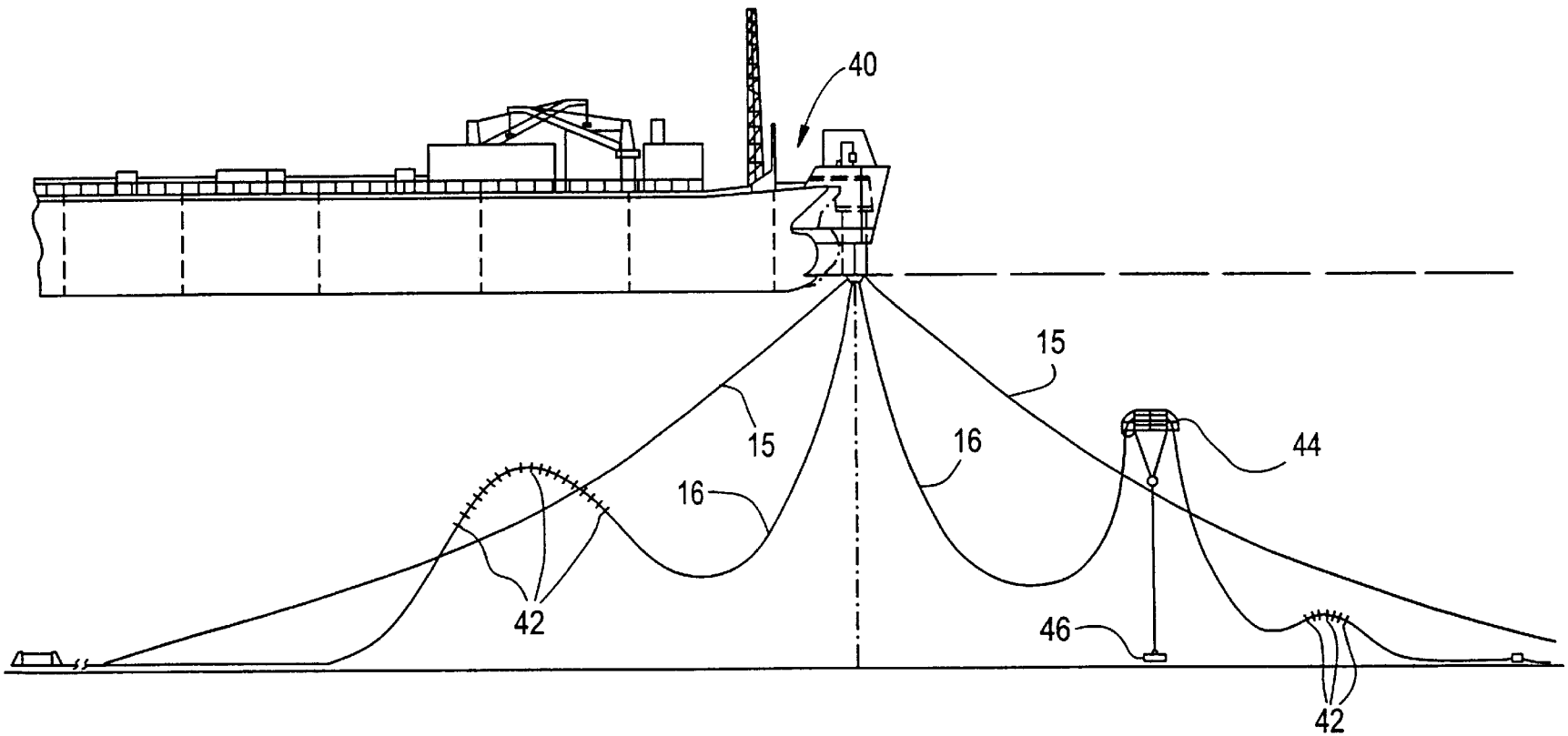
FIG. 3 is a general view of the vessel and turret of FIG. 1 with details of subsea pipework and mooring structure.

Typical moorings and risers for the system can be seen in FIG. 3.

The fluid transfer system has been designed to satisfy the following principal requirements:

(i) the turret will be bow-mounted, external to the vessel structure in the case of the FIG. 1 arrangement;

(ii) the arrangement will enable the vessel to weathervane through 360°;

(iii) the turret is to be moored with 12 off, 152 mm diameter chain mooring lines located in six pairs; and iv) the arrangement will provide suitable riser paths and maximise riser clearances.

Taking due account of these requirements, the preferred turret incorporates the following features.

The mooring chains 15 are brought up into the turret via the fairleads 17 passing through individual hawse pipes which form the principal vertical stiffening of the turret's inner cylinder 2. The chain ends are secured by the internal chain stoppers 18 located in the turret. Chain installation and tensioning is performed using a wire rope passing over a fairlead sheave (not shown) mounted on the upper section of the process deck, leading aft to a 150 tonne winch. This feature allows a simple installation procedure.

During installation, the FPSO vessel will be rotated onto the mooring heading and located on position using a series of tugs. The turret will be rotated and locked in position against the ship to maintain alignment of winch and hawse pipe.

The geostationary cylindrical manifold structure 3 is mounted on a stewing ring; this houses the process equipment, consisting of the riser ESD valves, block valves and non-return valves, carrying produced oil, export gas, lift gas and injection water to the production facility. In order to reduce the number of swivel flow paths, the three production risers may terminate in a production header piped into the swivel base.

Infield pigging is via temporary pigging stubs located upstream of the production riser ESD valves. Pigging will take place during suitable sea states with the turret locked off and the pigging jumper hoses connected back to the pigging system.

The production fluids are transferred to the vessel through the swivel assembly 20.

The three path swivel assembly 20 is mounted on the geometric centre of the turret providing the flow path between the geo-fixed and the ship-fixed flow lines. Control ESD and electrical systems (not shown) are linked through a series of slip rings to a central control room (CCR).

The complete turret assembly is weather protected by the deckhouse including the framework structure 6; this may be open at the rear to provide free air ventilation.

Access to the top of the turret, the swivel assembly 20 and the riser shut off valves is via the weather deck 5 of the tanker.

The manner in which an existing vessel such as an oil tanker is converted into an FPSO as shown in FIG. 1 will now be described. Initially, the bow area of the vessel is cleared of all fittings. Parts of the vessel's plating are removed in the areas where the mounting structure is to be attached to the vessel. A number of extension structures are then fitted to the existing vessel decks to provide part of the mounting structure. For example, as shown in FIG. 1, the bearing deck 4 is an extension of the vessel's second deck. Typically, further generally horizontal extensions 62 can be attached to other decks such as the upper deck. These extensions 62 are provided with apertures for accepting and retaining the turret assembly. The mounting structure can also include generally vertical extension structures 64 on each side of the assembly, as well as generally horizontal stringers extending from the original bow profile 30 of the vessel. These extension structures 62, 64 may be fabricated from 25 mm steel plate. Plating is then attached to the extension structures 62, 64 where required and, once the turret assembly, the manifold assembly 3, the swivel assembly 20 and piping as well as electrical connectors have been installed, the top framework structure 6 forming the deckhouse may be fitted.

FIGS. 2A and 2B show an integrated bow-mounted turret FPSO in which the turret assembly is similar to that of FIG. 1 and hence will not be described in detail. As will be explained below, the turret assembly is mounted generally at least partially within the existing bow structure of the vessel, in contrast with the FIG. 1 arrangement in which an extension structure is provided for the entire turret assembly. As can be seen in FIG. 2A, the turret centreline C is just aft of the tanker's FP.

FIG. 3 shows a typical arrangement for an FPSO vessel 40 including mooring and riser deployment. Although the vessel 40 is shown as being equipped with a turret structure according to FIG. 1, a similar arrangement would apply to one having a turret structure according to FIGS. 2A and 2B. It can be seen from FIG. 3 that the anchor chains 15 take up a catenary configuration when anchored to the sea bed. Some of the flexible risers 16 may have their static configuration determined by a number of buoyancy modules 42 attached to the risers 16. In other cases a midwater buoy 44 retained on the sea bed by a piled base frame 46 may be used, the midwater buoy 44 supporting the riser 16.

FIG. 4 shows the steps in converting a vessel 40 such as an oil tanker into an FPSO turret vessel as shown in FIGS. 2A and 2B.

Figure 4A:
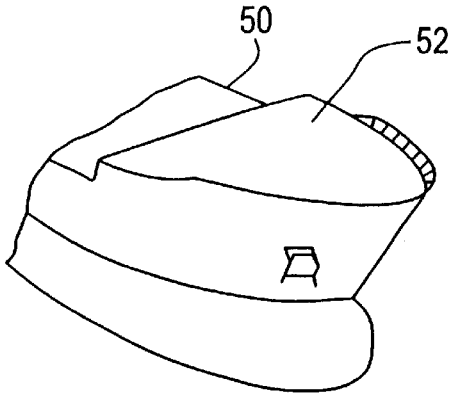
FIGS. 4(A)–4(H) show the construction steps in a method of converting a vessel into one equipped with a turret as shown in FIGS. 2A and 2B.
Figure 4B:
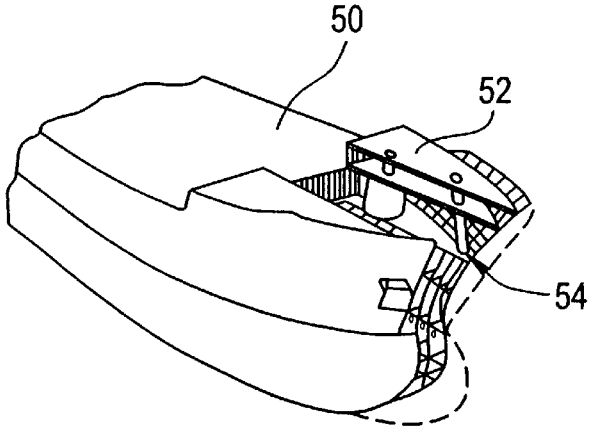
Figure 4C:
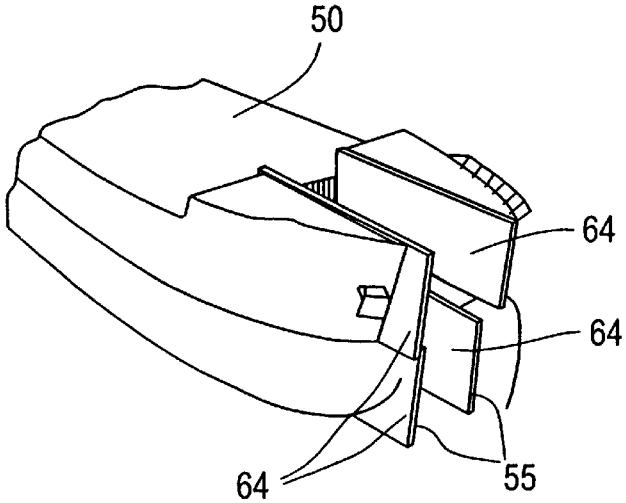
Figure 4D:
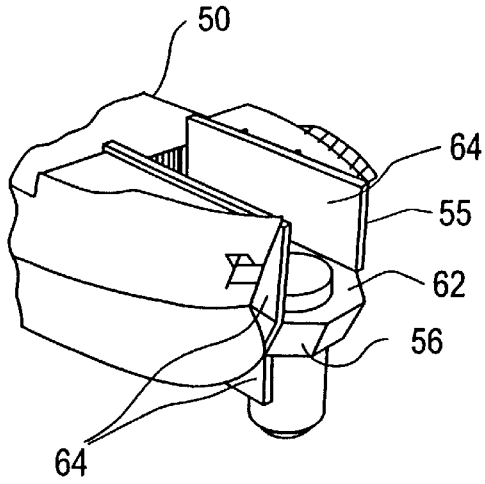
Figure 4E:
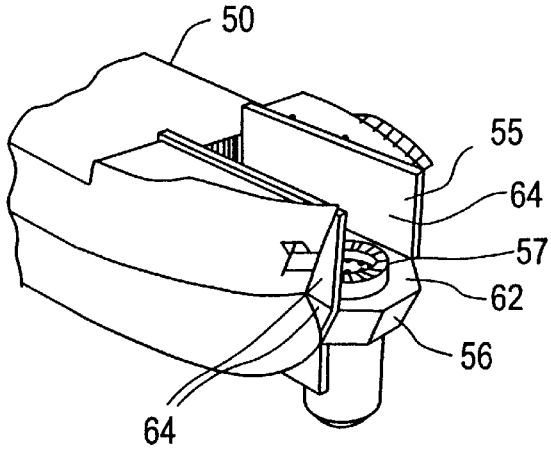
Figure 4F:
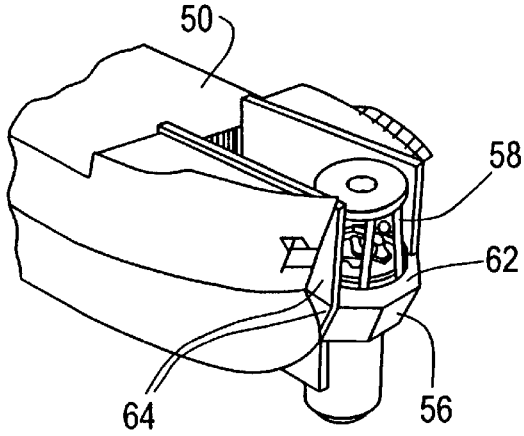
Figure 4G:
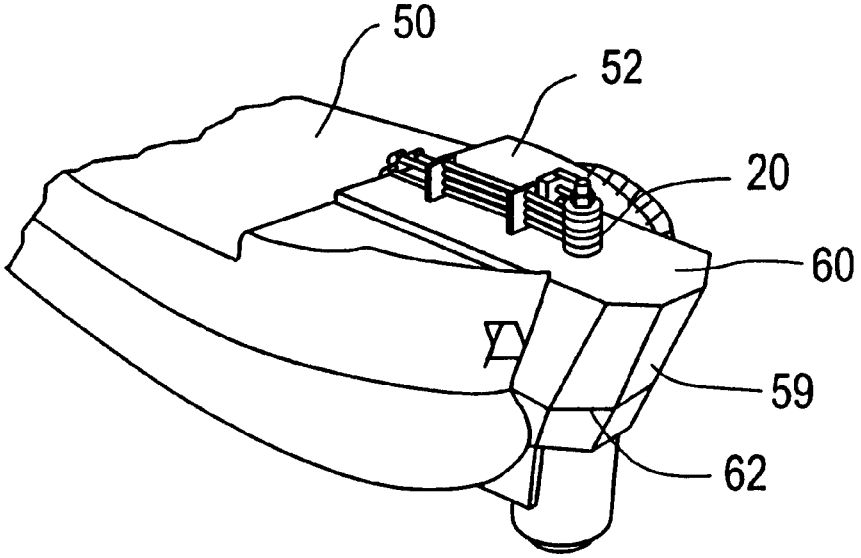
Figure 4H:
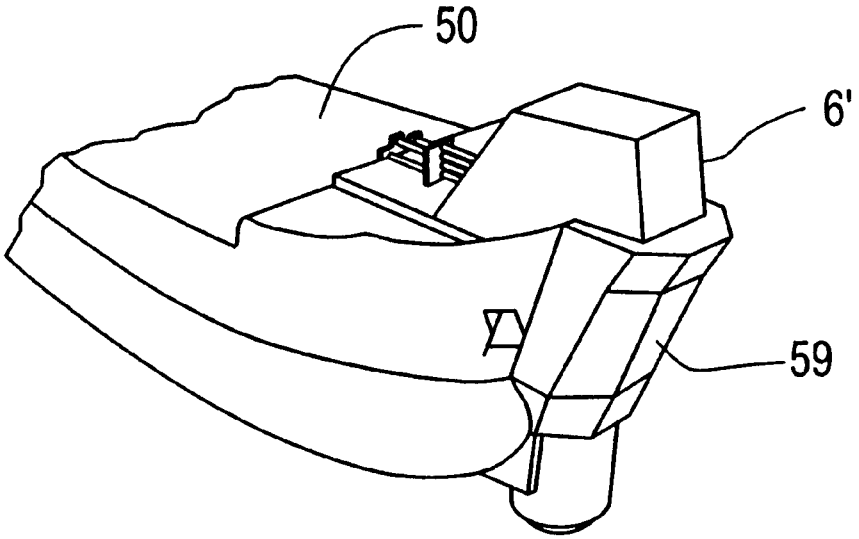

In step A (FIG. 4(A)), the forecastle deck 52 of the vessel is cleared of all existing machinery and fittings. In step B (FIG. 4(B)), the centre splice of the bow is removed leaving an opening 54 which is generally rectangular on the forecastle deck 52 when seen in plan. In step C (FIG. 4(C)), steel plating is attached within the opening 54, including at the sides, forming a longitudinal turret support structure 55. In step D (FIG. 4(D)), a turret casing 56, which is to include a turret assembly as previously described, is brought within the opening 54 and attached to the lower decks of the vessel 50. In step E (FIG. 4(E)), the turret assembly 57 is constructed by installation of the internal turret (or cylinder) and its bearings within the turret casing 56. In step F (FIG. 4(F)), a manifold structure 58 (including a manifold assembly 3 as previously described) is placed over and secured to the turret casing 56 and assembly 57. In step G (FIG. 4(G)), the swivel assembly 20 is installed over the manifold structure 58, as also are the necessary piping, electrics and subsea connections. Cladding 59 is added to enclose the upper turret structure including the manifold structure 58, and a weather deck 60 is added to the top, slightly raised relative to the forecastle deck 52. In step H (FIG. 4(H)), turret cladding, hook-up and commission is completed, including the addition of an upper framework structure 6' enclosing the swivel assembly 20.

Although the FPSO turret structures of FIG. 1 and FIGS. 2A and 2B have been described as being bow-mounted, this being the preferred configuration, they could instead be stern-mounted. Also, although conversion of an oil tanker is advantageous, since much of the existing infrastructure (tanks, piping etc.) can be used with little or no modification for FPSO purposes, any other vessel (self-powered or towed) could be used instead.

Thus, while specific embodiments of the invention have been shown and described in detail to illustrate the application of the principles of the invention, it will be understood that the invention may be embodied otherwise without departing from such principles.

What is claimed is:

1. A method of installing a turret system on to an existing vessel, the method comprising the steps of:

removing a portion of the existing structure of the vessel at one end thereof, the removed portion including external plating;

attaching a support structure to an exposed portion of the vessel remaining after removal of the existing structure portion, the support structure including turret support means and metal plating attached to the exposed portion;

attaching a turret assembly to the turret support means of the support structure;

installing fluid piping between the turret assembly and pipework of the vessel; and cladding the turret assembly for environmental protection thereof.

2. A method according to claim 1, including the step of attaching a framework structure at the top of the turret assembly.

3. A method according to claim 2, wherein the framework structure is attached to a weather deck of the vessel.

4. A method according to claim 1, claim 2 or claim 3, wherein the turret system is mounted externally of the original end of the vessel.

5. A method according to claim 4, wherein external plating at the end of the vessel is removed, and wherein said support structure comprises a plurality of extension structures attached to respective existing decks of the vessel thereby forming deck extensions.

6. A method according to claim 5, wherein generally vertical extension structures are attached to the vessel, on each side of the deck extensions.

7. A method according to claim 5, wherein generally horizontal stringers are attached to the vessel at different levels to the deck extensions.

8. A method according to claim 5, wherein the turret support means includes respective aperture for accepting and retaining the turret assembly.

9. A method according to claim 1, claim 2, or claim 3, wherein the turret system is mounted at least partially within the existing vessel.

10. A method according to claim 9, wherein the turret system is mounted at least substantially within the existing vessel.

11. A method according to claim 9, wherein the portion removing step comprises removing the centre splice of the vessel to a predetermined distance from the end thereof.

12. A method according to claim 11, wherein removal of the centre splice leaves a substantially rectangular opening when seen in plan on the topmost deck.

13. A method according to claim 11, wherein the metal plating is attached to the exposed portion remaining after removal of the centre splice.

14. A method according to claim 13, wherein the support structure further includes a turret casing which is assembled to the support structure plating.

15. A method according to claim 14, wherein, after the turret assembly has been fitted in the turret casing, a manifold structure is attached at the top of the turret casing.

16. A method according to claim 15, wherein, after the manifold structure has been attached to the turret casing, a fluid swivel is installed over the manifold structure.

17. A method according to claim 1, wherein the turret assembly is installed at the bow end of the vessel.

18. A floating production storage and offloading (FPSO) vessel, including a turret system installed on a converted vessel, the FPSO vessel comprising:

a support structure attached to an exposed portion of the vessel remaining after removal of a portion of the existing structure including external plating, the support structure including turret support means and metal plating attached to the exposed portion;

a turret assembly attached to the turret support means;

fluid piping between the turret assembly and pipework of the vessel; and cladding around the turret assembly for environmental protection thereof.

19. An FPSO vessel according to claim 18, comprising a framework structure attached at the top of the turret assembly.

20. An FPSO vessel according to claim 19, wherein the framework structure is attached to a weather deck of the vessel.

21. An FPSO vessel according to claim 18, claim 19 or claim 20, wherein the turret system is mounted externally of the original end of the vessel.

22. An FPSO vessel according to claim 21, wherein said support structure comprises a plurality of extension structures attached to respective decks of the vessel thereby forming deck extensions.

23. An FPSO vessel according to claim 22, wherein said support structure further comprises generally vertical extension structures attached to the vessel on each side of the deck extensions.

24. An FPSO vessel according to claim 22, wherein said support structure further comprises generally horizontal stringers attached to the vessel at different levels to the deck extensions.

25. An FPSO vessel according to claim 22, wherein the turret support means includes respective apertures for accepting and retaining the turret assembly.

26. An FPSO vessel according to claim 18, claim 19 or claim 20, wherein the turret system is mounted at least partially within the profile of the unconverted vessel.

27. An FPSO vessel according to claim 26, wherein the turret system is mounted at least substantially within the existing vessel.

28. An FPSO vessel according to claim 26, wherein the turret system is mounted within a removed centre splice of the vessel.

29. An FPSO vessel according to claim 28, wherein the metal plating is attached to the exposed portion of the vessel remaining after removal of the centre splice.

30. An FPSO vessel according to claim 29, wherein the support structure further includes a turret casing assembled to the support structure plating.

31. An FPSO vessel according to claim 30, including a manifold structure attached at the top of the turret casing.

32. An FPSO vessel according to claim 31, including a fluid swivel installed over the manifold structure.

33. An FPSO vessel according to claim 18, wherein the turret assembly is installed at the bow end of the vessel.

34. An FPSO vessel according to claim 18, wherein the vessel prior to conversion was an oil tanker.

* * * * *